United States Patent [19]

Subramanian

[11] Patent Number: 4,806,157

[45] Date of Patent: Feb. 21, 1989

[54] PROCESS FOR PRODUCING COMPACTED GRAPHITE IRON CASTINGS

[76] Inventor: Sundaresa V. Subramanian, 84, Bowman Street, Hamilton, Ontario, Canada, L8S 2T6

[21] Appl. No.: 683,725

[22] Filed: Dec. 19, 1984

Related U.S. Application Data

[63] Continuation-in-part of Ser. No. 507,130, Jun. 23, 1983, abandoned.

[51] Int. Cl.[4] ..... C21C 7/02

[52] U.S. Cl. ..... 420/30; 75/53; 75/58; 420/13

[58] Field of Search ..... 75/130 R, 53, 58

[56] References Cited

U.S. PATENT DOCUMENTS

| | | | |
|---|---|---|---|
| 2,485,760 | 10/1949 | Millis et al. | 75/123 |
| 3,336,118 | 8/1967 | Newitt | 29/192 |
| 3,421,886 | 1/1969 | Schelleng | 420/22 |
| 3,658,115 | 4/1972 | Ryntz, Jr. et al. | 164/57.1 |
| 3,703,922 | 11/1972 | Dunks et al. | 164/57.1 |
| 3,765,876 | 10/1973 | Moore | 420/22 |
| 3,816,103 | 6/1974 | Link, Jr. et al. | 75/58 |
| 3,819,365 | 6/1974 | McCaulay et al. | 420/20 |
| 4,004,630 | 1/1977 | Dunks | 164/57.1 |
| 4,134,757 | 1/1979 | Roberts | 420/30 |
| 4,227,924 | 10/1980 | Subramanian | 420/30 |
| 4,286,646 | 9/1981 | Beyer | 164/57.1 |
| 4,396,428 | 8/1983 | Linebarger | 420/22 |
| 4,501,612 | 2/1965 | Stefanescu | 75/130 R |

FOREIGN PATENT DOCUMENTS

| | | |
|---|---|---|
| 507458 | 8/1978 | Australia . |
| 1268706 | 3/1972 | United Kingdom . |
| 1316438 | 5/1973 | United Kingdom . |

OTHER PUBLICATIONS

H. Morrough, "Production of Nodular Graphite Structures in Gray Cast Irons", AFS Transactions, vol. 56, 1948.

H. Morrough and W. J. Williams, "The Production of Nodular Graphite Structure in Cast Iron", JISI, Mar. 1948, pp. 306-322.

J. Sissener et al, "Use of Cast Iron With Vermicular Graphite From A Technical & Commercial Viewpoint", Giesserei-Rundschau, No. 6, Jun. 1972, pp. 60-65.

D. Strasky, "Inoculation of Cast Iron With Rare-Earth Metal Complexes", Slevarenstvi, 1976, 24 2/3, 78-81.

N. A. Voronova et al, "Features of the Structure and Properties of Ingot Moulds in Cerium-Treated Iron", Russian Coasting Production pp. 531-533 (1968).

E. R. Evans et al, "Compacted Graphite Cast Iron and Their Production by a Single Alloy Addition", International Cast Metals Journal, Jun. 1976.

Foote Mineral Company, "New Graphite Cast Iron From Single Ferroalloy", Materials Engineering, Jun. 1976, Bulletin 764.

M. J. Lalich, "Compacted Graphite Cast Iron-Its Properties and Production With a New Alloy", Modern Castings, Jul. 1976, Bulletin 765.

Foote Mineral Company, Technical Data CG TM Alloy, Bulletin 243-A (undated).

M. J. Lalich, "Effects of Rare Earths on Structure and Properties of Cast Iron"-Foundry M & T, Mar. 1978.

*Primary Examiner*—Peter D. Rosenberg

*Attorney, Agent, or Firm*—Kramer and Brufsky

[57] ABSTRACT

A process for producing compacted graphite cast iron thin walled shaped castings in a high productivity line is provided which comprises: (i) forming a near eutectic melt of cast iron, having a low sulfur content, preferably around 0.01% by weight; (ii) adding to the melt sufficient graphite stabilizing agents such as silicon to suppress the carbide eutectic formation at the large undercooling characteristic of thinner sections of the castings; (iii) admixing at least one rare earth containing additive with said melt to form rare earth compounds so as to reduce and maintain the Henrian oxygen activity in the melt at about $10^{-6}$; (iv) inoculating the melt in an optimum manner to promote the required degree of interconnected vermicular graphite growth, and (v) casting the resulting melt. The nucleation step is better controlled by inoculating each mold individually just prior to casting, by inoculating the molten metal as it enters the mold, or in the path of molten metal at the pouring basin, sprue or between sprue and ingate in the mold.

14 Claims, 11 Drawing Sheets

THIN SECTION (6-8 mm)

THICK SECTION (16-18 mm)

THIN SECTION (6-8 mm)

THICK SECTION (16-18 mm)

LINE DELAY — 20 min

PROCESS FOR PRODUCING COMPACTED GRAPHITE IRON CASTINGS

CROSS REFERENCE TO RELATED APPLICATION

This application is a continuation-in-part of copending application Ser. No. 507,130 filed June 23, 1983, abandoned.

BACKGROUND OF THE INVENTION

1. Field of Invention

This invention relates to methods for manufacturing compacted graphite cast iron with a uniform distribution of vermicular or compacted graphite in thin walled shaped castings involving a range of cross sectional sizes. More particularly, this invention relates to continuous methods for manufacturing shaped castings, which have a uniformly distributed vermicular or compacted graphite morphology throughout the casting. Still more particularly, this invention relates to continuous, automated, high productivity methods for producing shaped castings of compacted graphite iron. The methods can be readily adopted by foundries presently equipped with high productivity, automated lines for production of ductile iron castings by nodularizing treatment inside the mold. The invention can be used for producing compacted graphite iron castings intermittently in a production line that is otherwise automated to produce ductile iron castings.

2. Description of the Prior Art

High productivity automotive lines have adopted a nodularizing treatment inside the mold, referred to hereafter as the "in-mold process", because the in-mold process better lends itself to automation than previous processes that involved batch treatment (i.e., sandwich or plunge processes). In the in-mold process, measured quantities of a graded magnesium ferrosilicon treatment alloy are introduced into a reaction chamber in the mold and the liquid iron to be treated is directed to flow over the treatment alloy in the reaction chamber. The incoming metal, having a well-controlled chemistry reacts with the magnesium ferro-silicon alloy in the mold resulting in a spheroidal graphite structure which imparts ductility to the cast iron. Descriptions of the in-mold technique can be found in U.S. Pat. Nos. 3,703,922, 3,819,365, 4,004,630 and 4,134,757 and British patents Nos. 743,121, 1,132,055 and 1,132,056.

During the in-mold process, the turbulence generated by magnesium vapor is used to advantage to ensure good mixing of the alloy with the melt. Also, the ferrosilicon serves not only as a convenient carrier of magnesium, but in addition inoculates the melt, producing the required number of graphite nuclei and thereby suppressing eutectic carbide formation. By carrying out the magnesium treatment inside the mold, good recovery of magnesium is ensured with minimal pollution problems. Further, the degeneration of graphite spherulitic structure caused by reoxidation is minimized. Also, a high nodule count is ensured, as there is no holding time involved for fading to occur. In comparison, in a batch treatment, the holding duration increases from the first casting poured till the last one, and consequently the quality of the castings within a batch varies. With the continuous in-mold process, on the other hand, this inherent variation of the batch process is eliminated.

An automated ductile line in a high productivity foundry typically consists of:

(i) A dispensing system for introducing measured quantities of the magnesium ferro-silicon treatment alloy into a pocket in the mold prior to the closing of the top half of the mold (i.e., cope).

(ii) A pouring ladle system in which a measured quantity of liquid metal is received into a ladle attached to the end of a radial arm, which swings into position and locks onto a traversing mold on a conveyor system. Liquid metal from the ladle is dispensed into the pouring basin of the mold, once the ladle locks into position.

(iii) After dispensing the liquid metal into the pouring basin of the mold, the arm swings through an idle cycle, before it locks into position at a metal receiving station. Typically, a number of radial arms are mounted on a central pivot, and the rate of pouring is varied to match the rate of production of the mold.

The ease of operation of the high productivity automated line for the manufacture of ductile iron castings having a spheroidal graphite structure has led to attempts to develop an in-mold alloy suitable for the production of iron castings having a compacted graphite structure. Since the turbulence created by magnesium vapor has been considered essential for the homogeneous mixing of the treatment alloy, the efforts to produce compacted graphite iron heretofore have focused on the development of an in-mold alloy based on magnesium.

Because of the narrow critical range (i.e., narrow window) within which magnesium is effective to provide compacted graphite morphology, the control of compacted graphite iron technology based on magnesium-containing in-mold alloys has proved formidable. Too little magnesium does not produce full compacted graphite structure; while over-treatment produces nodular graphite. The difference between under- and over-treatment can be as little as 0.005% by weight of magnesium.

Wider latitude or tolerance for magnesium has been obtained by using magnesium in conjunction with titanium to suppress the formation of nodular graphite. In such cases, however, a further complication is encountered in the formation of additional inclusions of titanium carbo-nitrides. See, for example, Schelleng, U.S. Pat. No. 3,421,886. Moreover, residual titanium in the recycled scrap will prove detrimental to the development of fully nodular graphite and thus impair the physical properties of ductile iron castings produced from the melt contaminated with titanium. In practice, it is not possible in an automated foundry to segregate scrap containing residual titanium arising from compacted graphite iron castings produced by magnesium-titanium technology, from those of ductile iron return scrap. Therefore, the process route for compacted graphite iron based on magnesium-titanium alloys is not favored in foundries that predominantly produce ductile iron castings lest there should be contamination of ductile iron castings by titanium.

Efforts to design treatment alloys based on a fixed ratio of magnesium to cerium or rare earths, in combination with inoculants, by empirical methods have not, as yet, yielded consistent results because of the difficulty in designing an optimal alloy to achieve the narrow window of magnesium required by compacted graphite, under the operating conditions in the field.

A recent patent, U.S. Pat. No. 4,396,428, is directed to the development of a low silicon, but magnesiumbearing iron alloy in order to establish a ready supply of treated molten iron in the holding vessels with a selected composition at a given temperature. However, the control of compacted graphite morphology warrants that the residual magnesium should be controlled within a narrow window and therefore the technology based on magnesium is inherently difficult to control. For the same reason, efforts to design treatment processes based on the injection of molten additives containing magnesium under high kinetic energy as in U.S. Pat. No. 4,227,924 are rendered difficult, in the case of compacted graphite iron.

Subramanian et al have identified the broader window offered by rare earths to control the impurity concentrations in the cast iron melt for the consistent production of compacted graphite morphology in thick sections of tonnage castings, see U.S. Pat. No. 4,227,924. For instance the model test blocks used in examples 2–6 cited in the patent are of size 15"×15"×8". At slow cooling rates characteristic of such thick sections, there is negligible kinetic undercooling, and therefore the freezing occurs at near equilibrium conditions. At such low undercoolings typical of thick sections, the competitive growth of the carbide (cementite) phase does not occur. Accordingly, inoculation is not cited as an essential step to control the compacted graphite morphology. Further, at such low undercoolings involving smaller driving forces for graphite growth, the impurity dependent crystal growth mechanism that favors compacted graphite growth dominates over spherulitic graphite growth, thereby minimizing the nodularity problem in compacted graphite structure. Thus, in the absence of both the carbide problem and the nodularity problem at the small undercoolings operating in thick sections, the production of compacted graphite morphology is determined by controlling the impurity concentrations in the melt, to correspond to a Henrian sulfur activity window between 0.004 and 0.035, the upper and lower bounds of the Henrian oxygen activity window being $10^{-b\,4}$ and $10^{-6}$.

In a thin walled shaped casting involving a range of cross sectional sizes, a range of cooling rates and therefore, a range of kinetic undercoolings are involved; the thinner the section size, the larger the kinetic undercooling or the deviation from equilibrium freezing. Consequently, the structure varies as a function of cross sectional size. Thus, thinner sections freeze with large kinetic undercooling, leading to significant deviation from equilibrium freezing, in marked contrast to thicker sections that freeze under near equilibrium conditions.

Under the conditions of large kinetic undercoolings that characterize the freezing of thinner cross sections, competitive growth of cementite dominates over graphite growth, resulting in the formation of hard and brittle carbide eutectic structure. Further, under conditions of large kinetic undercoolings, the spiral growth on the basal face of graphite that promotes spherulitic morphology dominates over impurity dependent crystal growth mechanisms that promote prism flake growth also described hereinbelow. Consequently the tendency for nodularity increases as the cross section size decreases. The graphite morphological variation as a function of section size in a casting is referred to as section sensitivity of the casting. In FIG. 1 described hereinbelow, the design of a finned casting used in the section sensitivity test is illustrated; FIG. 2, also described hereinbelow, shows a typical increase in the degree of nodularity as the section size decreases, in a melt treated with cerium to produce compacted graphite morphology in thicker sections and inoculated with ferrosilicon just prior to casting. On holding the melt after inoculation prior to casting, carbides develop in thinner sections of the fins. Thus, compacted graphite morphology control in thinner sections of a shaped casting is inherently more difficult than in thicker sections because the thinner sections freeze with a large kinetic undercooling that deviates significantly from equilibrium freezing conditions, and are therefore prone to a greater tendency toward carbide formation and an increased degree of nodularity.

SUMMARY OF THE INVENTION

In view of the many problems associated with the use of magnesium and magnesium-containing alloys to produce compacted graphite structure, it is an object of the present invention to provide a reliable process for rapidly producing compacted graphite iron which is not based on magnesium.

It is another object of the present invention to provide a reliable process for obtaining compacted graphite morphology in a thin walled shaped casting involving a range of cross sectional sizes.

It is a further object of the present invention to eliminate the formation of carbides in thin sections.

It is still another object of the present invention to promote the required degree of interconnected vermicular graphite growth in thinner sections with a minimal degree of nodularity.

It is a still further object of the present invention to reliably and rapidly produce compacted graphite iron using a continuous process of the type currently practiced on automated high productivity lines in which the nodularizing treatment is carried out inside the mold.

It is another object of the present invention to avoid the use of titanium in the alloy design.

It is still another object to provide compacted graphite iron with residuals that are not harmful to the development of spherulitic morphology and, thus, do not present any problems to ductile iron production through charge contamination.

It is another object of the process to provide processes that are compatible with high productivity automated ductile lines.

It is another object of the present invention to provide a process for the production of compacted graphite iron thin walled shaped castings intermiteently in a production line that otherwise is designed to produce ductile iron using nodularizing treatment in the mold.

These as well as other objects are achieved through the present invention, which provides processes for controllably providing compacted graphite iron castings comprising the steps of:

(i) forming a near eutectic melt of cast iron having the chemistry of a ductile base metal for use in the in-mold treatment and having a low sulfur content, for example, about 0.01% by weight;

(ii) adding to the melt sufficient graphite stabilizing agent, e.g., silicon, to suppress the carbide eutectic formation at large undercoolings characteristic of thinner sections of the casting;

(iii) admixing at least one rare earth containing additive with said melt, e.g., by introducing a measured quantity of the additive into the pouring ladle just prior to tapping of the metal, the quantity of the additive being computed on the basis of reducing and maintaining Henrian activity of residual oxygen within the range of about $10^{-5}$ and $10^{-7}$ or more preferably within the range of about $10^{-5.5}$ and $10^{-6.5}$, or most preferably to about $10^{-6}$;

(iv) tapping a predetermined quantity of liquid metal into the pouring ladle containing the additive; and (v) inoculating the melt and thereby provide the required degree of interconnected vermicular graphite growth. As the control of the required degree of nucleation is a critical step, this process step is preferably conducted by inoculating each mold individually just prior to casting, just as the molten metal enters the mold or inside the mold, for example in the molten metal path at the pouring basin, sprue or at a location between the sprue and ingate such as the nodularizing cavity or in-mold reaction chamber.

BRIEF DESCRIPTION OF THE DRAWINGS

The present invention is discussed in detail below with reference to the drawings, wherein.

(ii) Sprue inoculation as the liquid enters the sprue and flows over the sprue basin.

(iii) inoculation in a reaction chamber located in the molten metal path between the sprue basin and the ingate.

Figure 8:
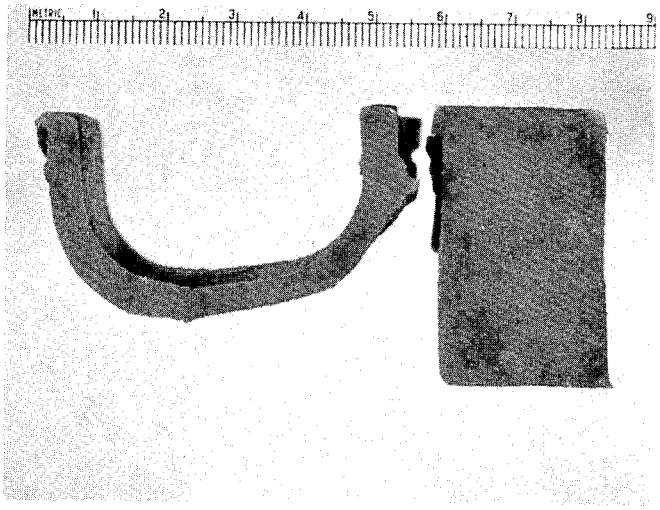

FIG. 8 shows a photograph of two sections of a casting made in accordance with the present invention. The thinner section is 4 mm. thick, and the thicker section is 22 mm. thick.

Figure 9:
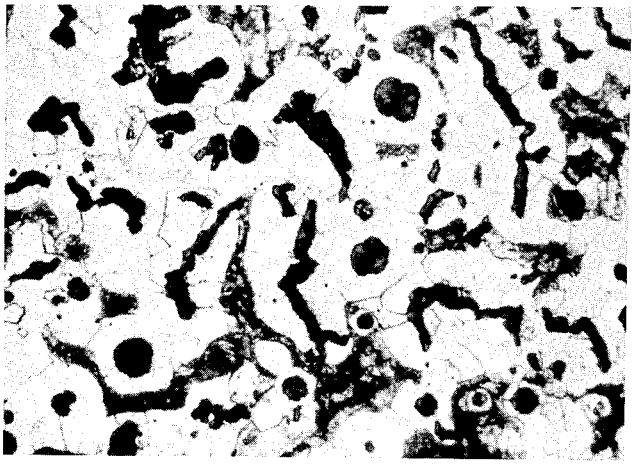

FIG. 9 is an optical micrograph (200×) of a polished section representative of the thinnest region of the casting, i.e., the 4 mm. thick section. The compacted graphite (dark) is shown uniformly distributed throughout a ferrite-pearlite matrix. It should be noted that the compacted graphite iron is further characterized by the absence of eutectic carbides.

Figure 1:
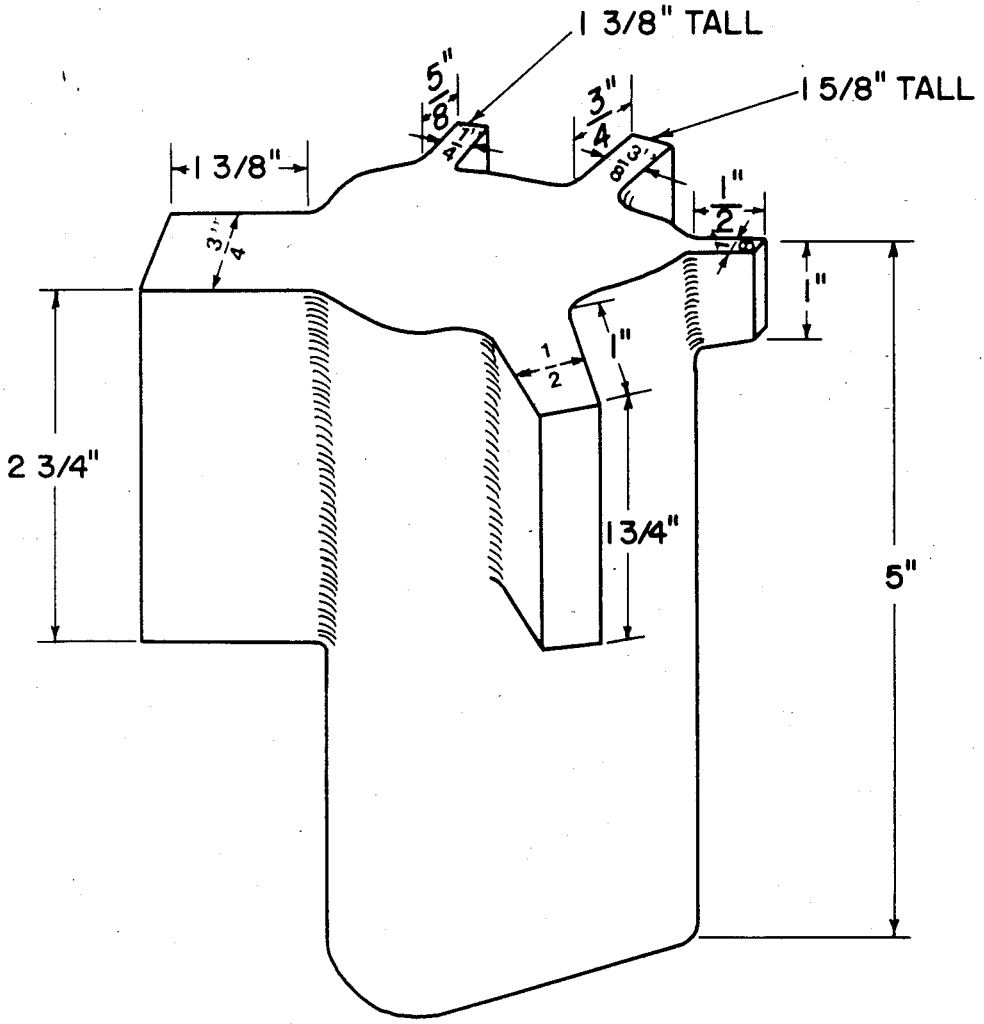
FIG. 1 illustrates the design of a five fin pattern used in the section sensitivity test. The section thickness of the fins ranges from ¾" to ⅛"
Figure 2:
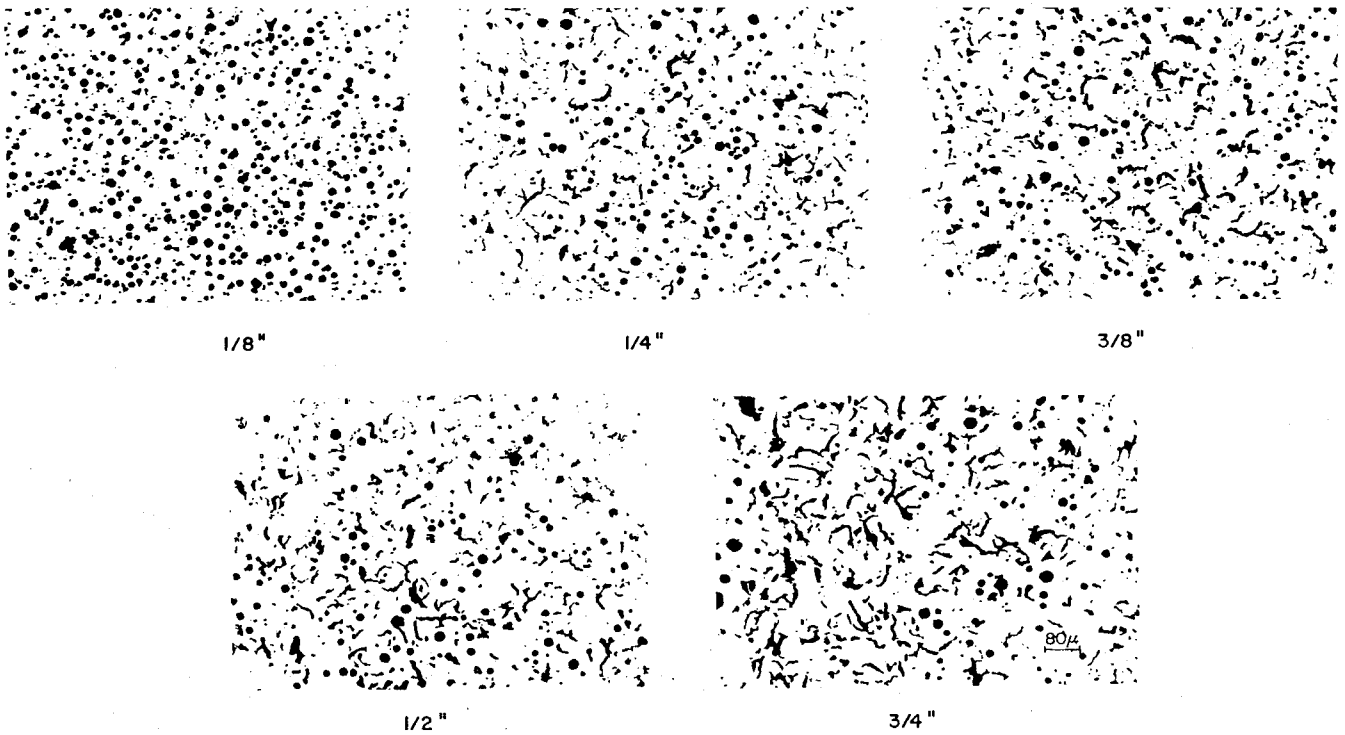
In FIG. 2, 45 kgs of a cast iron melt of analysis 3.6% C, 1.4% Si, 0.6% Mn and 0.009% S was raised in temperature to 1510° C. and treated with 25 grams of cerium. Each 5 kg of melt was taken out at intervals of 3 minutes in a pouring ladle and inoculated with 0.9% ferrosilicon (75% Si grade) and top poured into an oil-bonded sand mold. The section sensitivity at the end of 3 minutes of holding in the furnace is shown in FIG. 2 in the microstructural comparison that compares the graphite morphology as a function of fin section sizes. Note the increase in nodularity as the section size decreases to ⅛".
Figure 10:
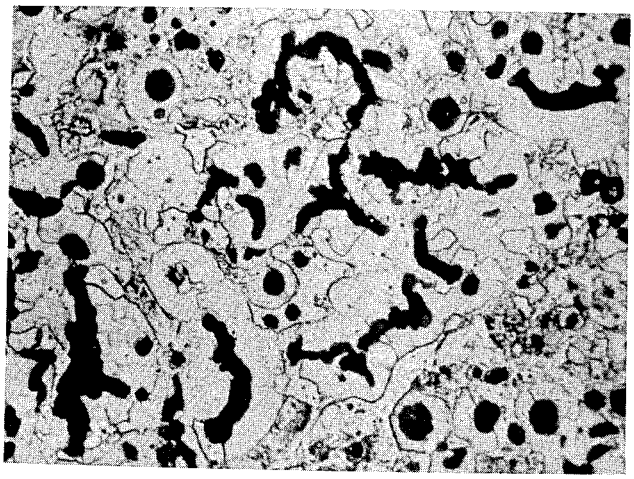

FIG. 10 is an optical micrograph (200×) of a polished section taken from the thickest section of the casting, i.e., the 22 mm thick section. The compacted graphite (dark) is again uniformly distributed. It should be noted that the nodularity of the thickest section is clearly less than that of the thinnest section but the section sensitivity is clearly less than that in FIG. 2. Also, the structure is characterized by the absence of eutectic carbides.

Figure 11A:
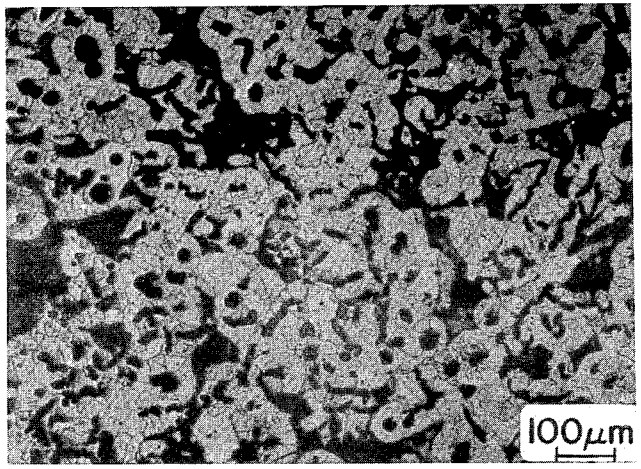
Figure 11B:
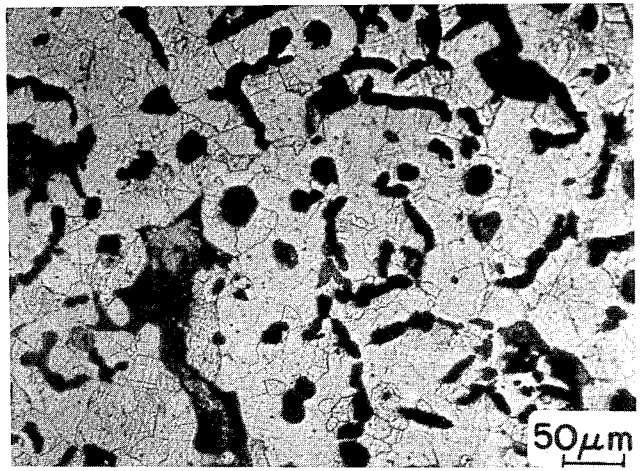
Figure 11C:
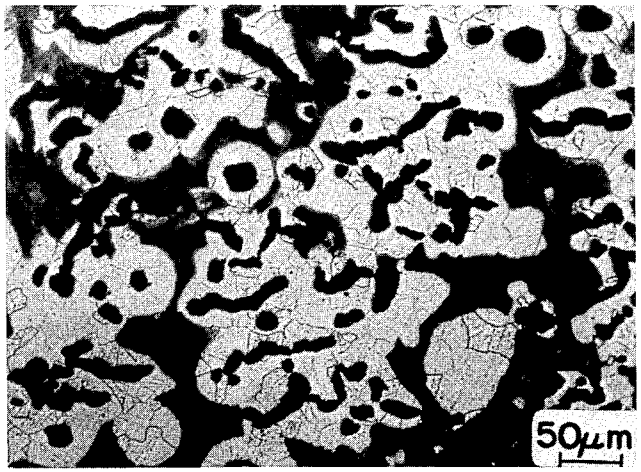
Figure 12A:
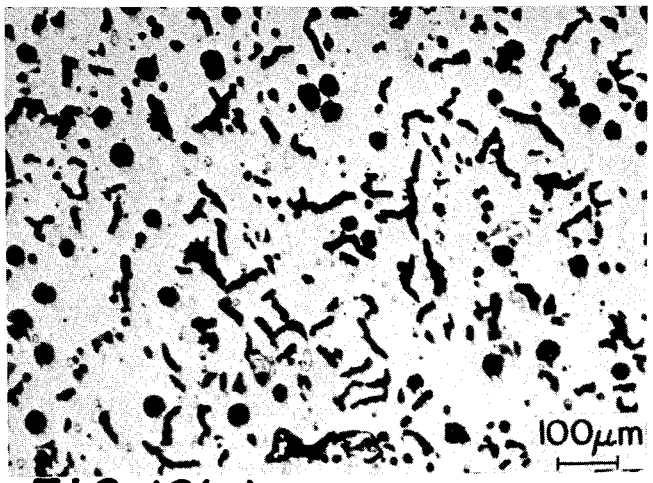
Figure 12B:
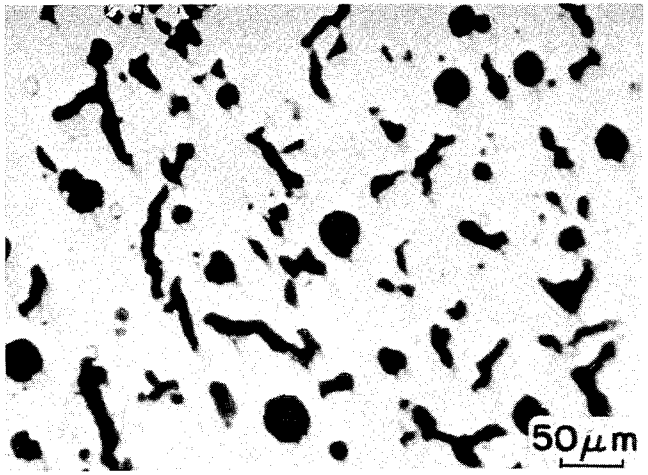
Figure 12C:
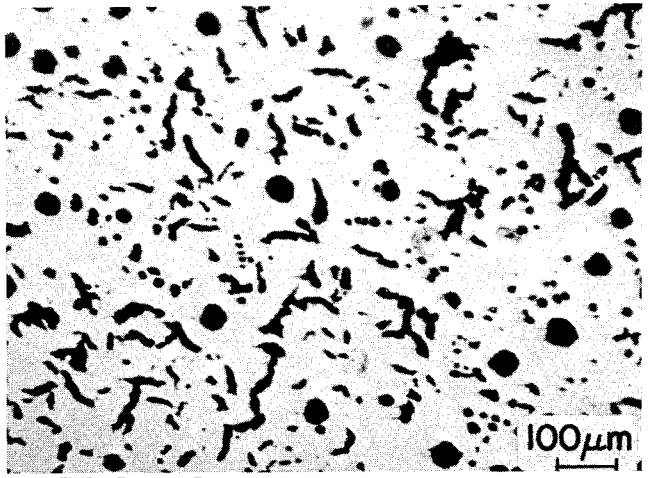
Figure 12D:
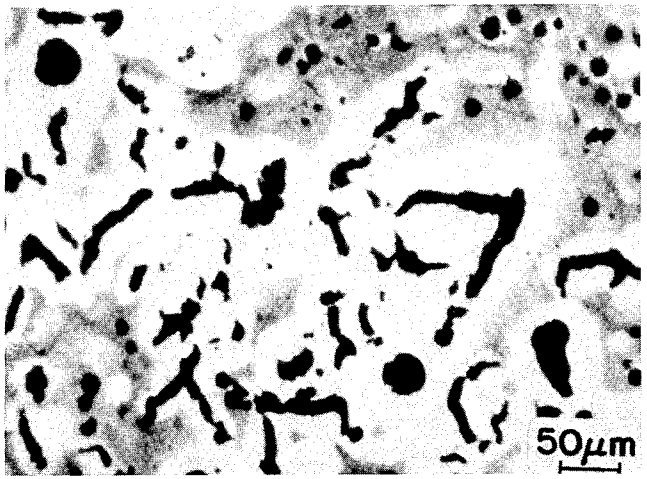

FIG. 11 (*a*)-(*c*) shows optical micrographs of specimens taken from a casting that was produced in accordance with this invention, using a commerical grade rare earth silicide, containing 31% rare earths. The upper micrographs (a) and (b) taken at magnification 100× and 200× respectively, of a thin section (6 mm) of the casting show compacted graphite dispersed in a ferrite pearlite matrix. Apart from graphite, the other dark etching constituent is pearlite. The lower micrograph, (c) taken at a magnification of 200× of the thick section of the casting (18 mm) exhibits compacted graphite in a ferrite pearlite matrix. The thin section does not exhibit the carbide phase; the nodularity in the thin section is not pronounced.

FIG. 12 (*a*)-(*d*) shows the microstructural results of a casting that was held for 20 minutes in the pouring ladle after rare earth treatment, on account of a hold up of the line, before the casting was poured. The microstructures of thin (6 mm) and thick (18 mm) sections seen at magnifications 100' and 200× clearly show compacted graphite morphology without any significant fading.

DESCRIPTION OF THE PREFERRED EMBODIMENTS

Figure 3:
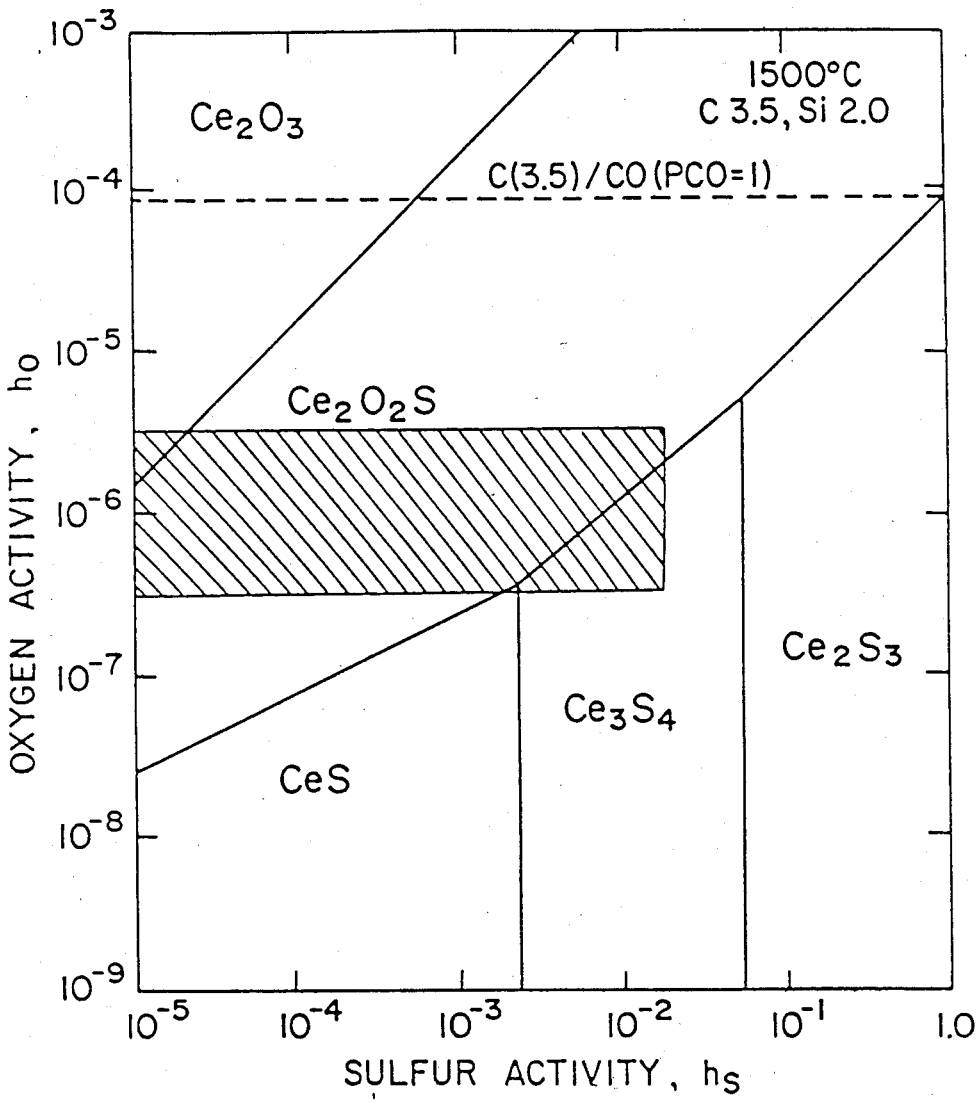
FIG. 3 is a graphical representation of the Henrian oxygen activity in equilibrium with the Henrian sulfur activity in an iron melt having an effective carbon concentration of 3.5 wt % and silicon concentration of 2.0 wt % at 1500° C. The graph illustrates regions wherein various rare earth compounds exist as stable phases. In particular, the shaded region illustrates the Henrian sulfur and oxygen activity equilibrium levels in the cast iron melt, which upon solidification gives rise to the vermicular graphite morphology in thin walled shaped castings, over the entire range of section sizes, provided there is an optimum nucleation of graphite. The horizontal dotted line represents the equilibrium oxygen level attributable to the presence of 3.5% carbon in the melt at a carbon monoxide partial pressure of one atmosphere at 1500° C.
Figure 4:
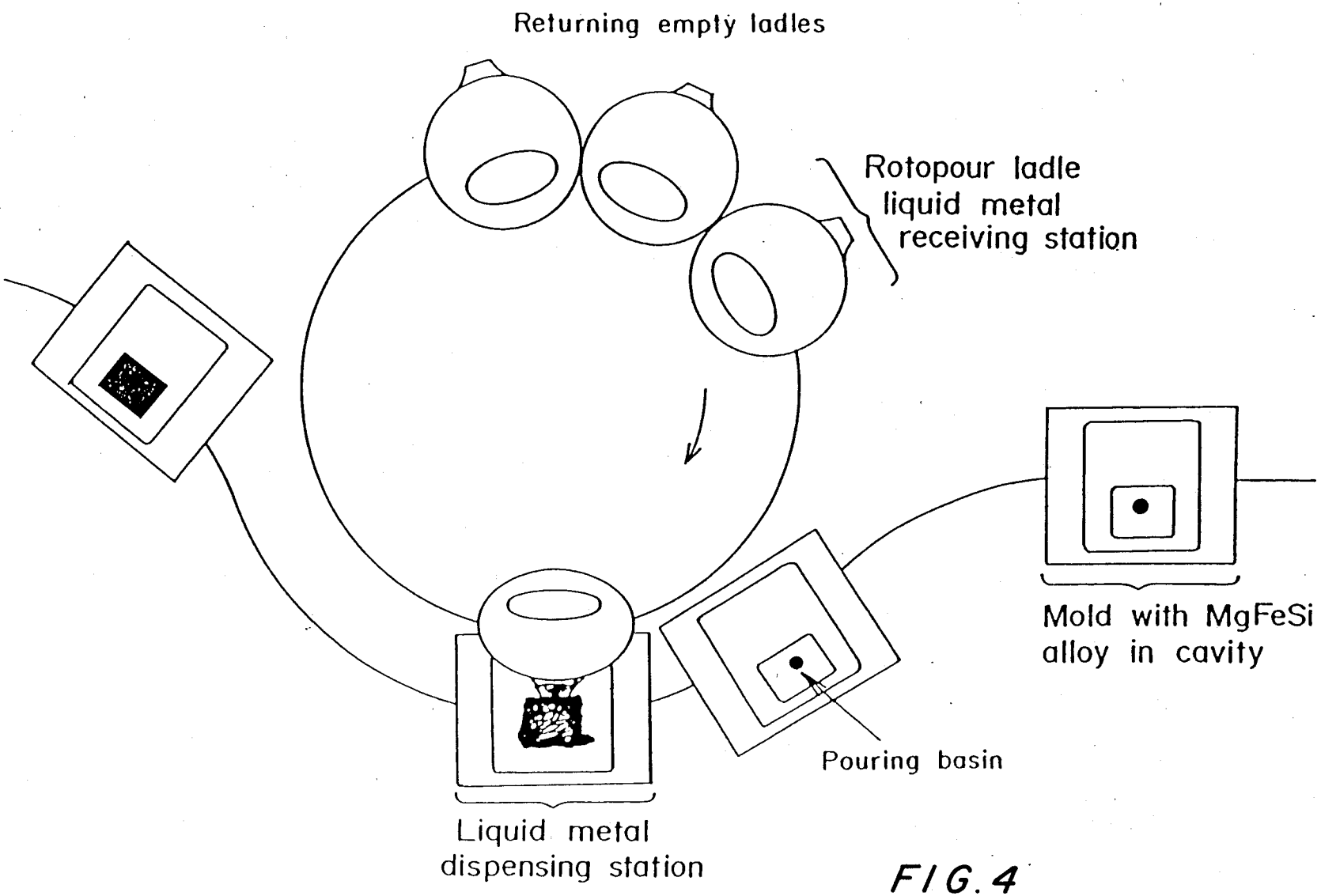
FIG. 4 shows a flow diagram of a typical automated high productivity line for producing ductile iron castings using nodularizing treatment in the mold. The notable features are that a series of molds are carried by a conveyor system; the pouring ladles carried by a radial arm lock into position and receive a predetermined quantity of liquid metal at a receiving station; the ladle carrying radial arm swings and locks into position over the mold and dispenses the melt into the pouring basin of the mold.
Figure 5:
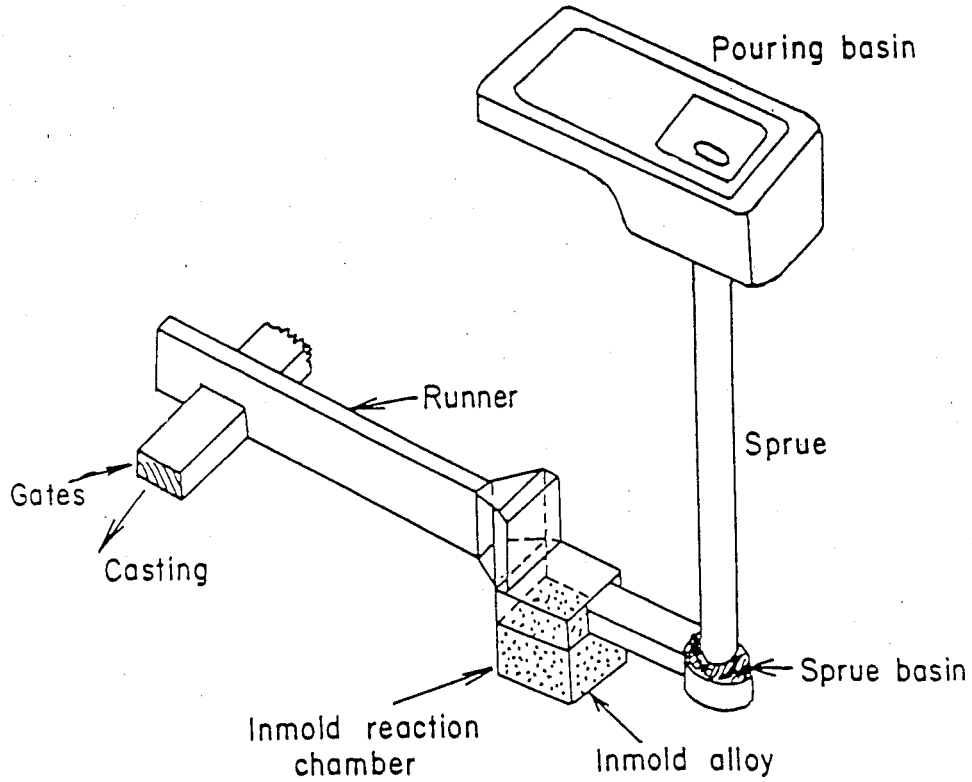
FIG. 5 shows a schematic diagram indicating the location of a reaction chamber in the mold with respect to the pouring basin sprue in a typical gating design for nodularizing treatment in the mold.
Figure 6:
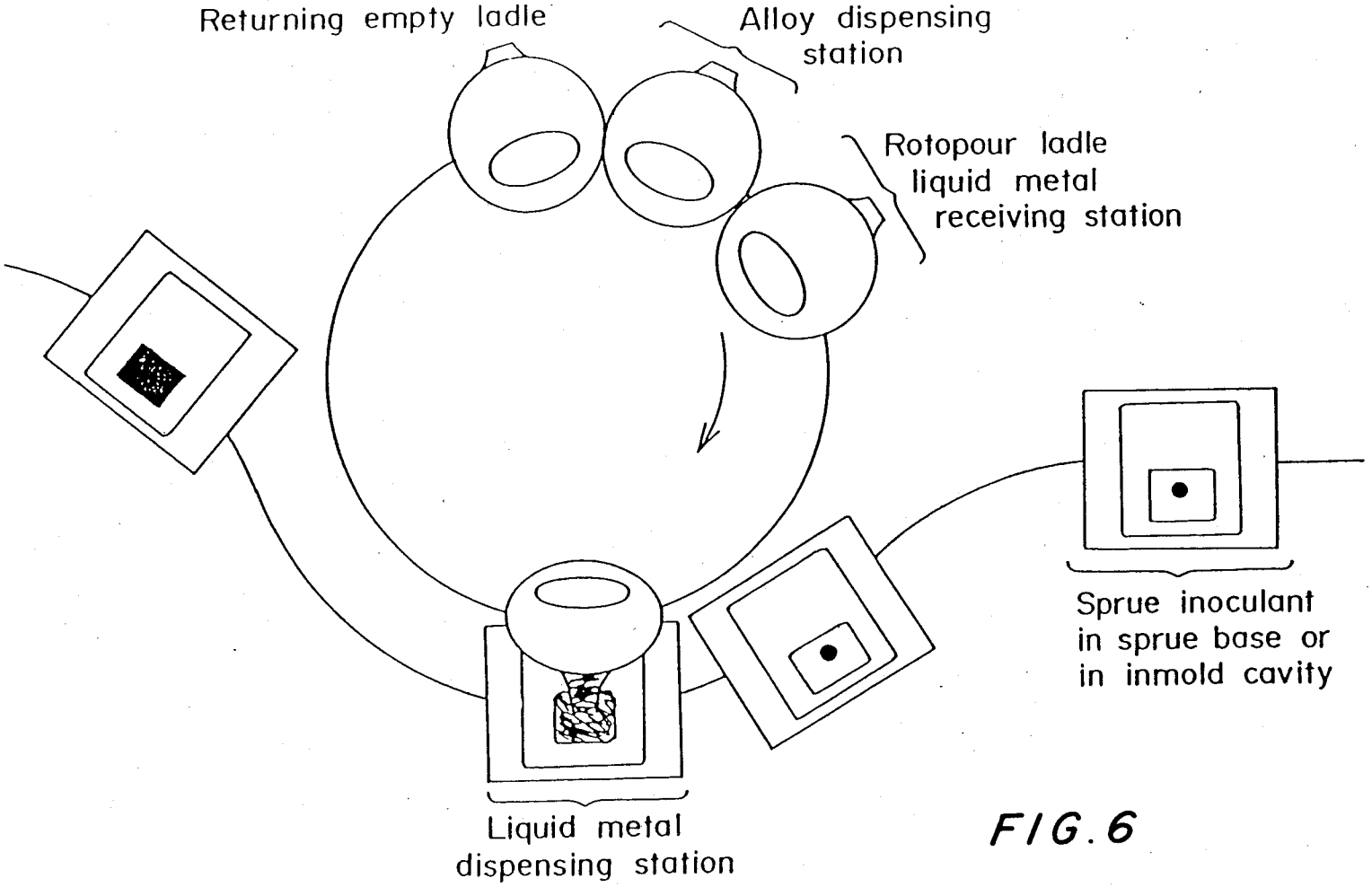
FIG. 6 shows a flow diagram of the process steps in accordance with the present invention. In addition to the stations shown in FIG. 4, there is the additional station labelled "alloy dispensing station" for dispensing a rare earth containing alloy into the ladle, which is returning empty after dispensing the melt into the mold. After the alloy dispensing station, the pouring ladle swings to the liquid metal receiving station.
Figure 7:
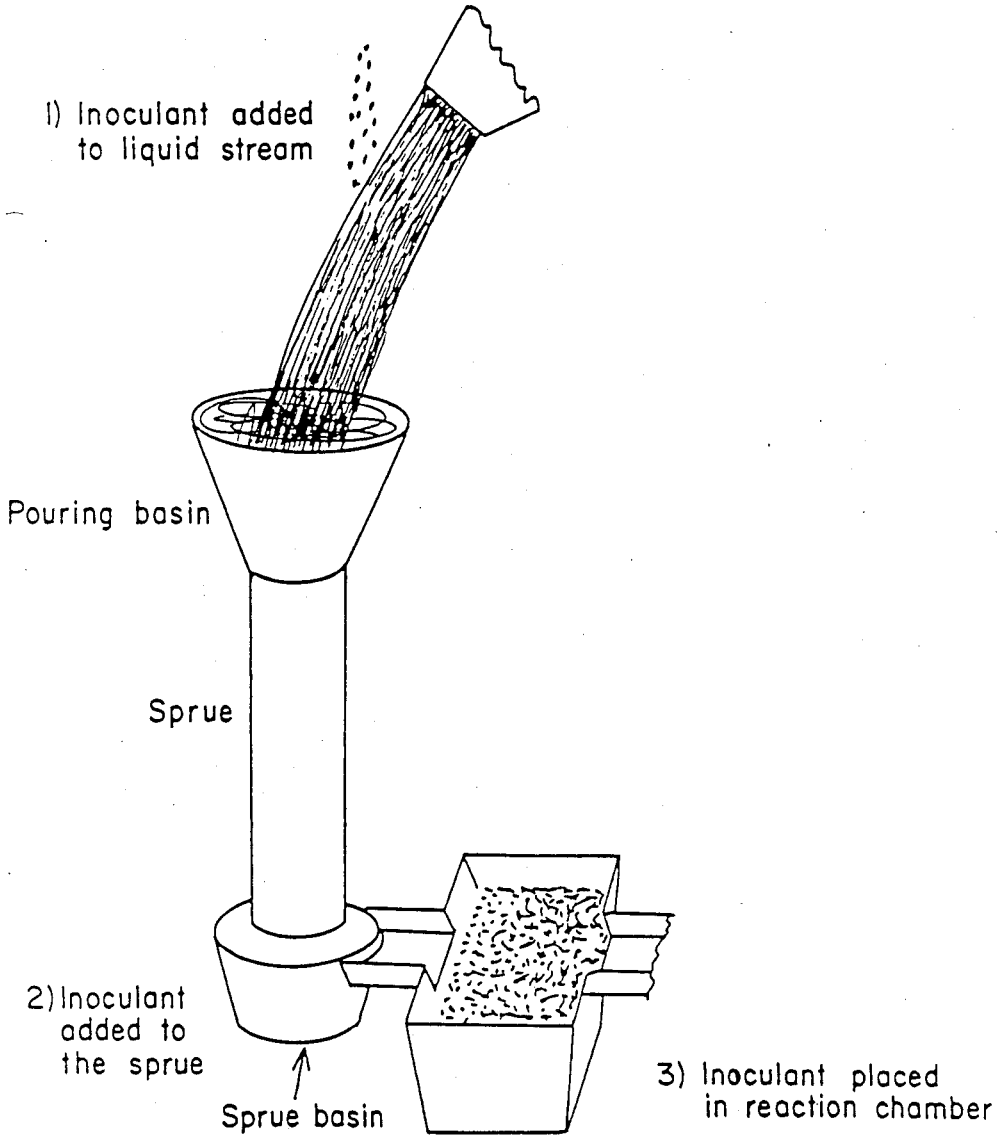
FIG. 7 shows three possible locations for the addition of the inoculant—i.e., (i) Stream inoculation as the liquid stream falls into the pouring basin.

At large undercoolings characteristic of thin sections that deviate significantly from equilibrium, it has now been discovered that in ultra low sulfur iron containing sulfur impurity at concentrations less than 10 parts per million, (i.e., a Henrian sulfur activity of about $10^{-3}$), compacted graphite morphology can be consistently obtained if the Henrian oxygen activity is lowered and maintained at about $10^{-6}$. Further, it has been discovered that once the melt picks up oxygen impurity and the dissolved oxygen concentration increases, the compacted graphite morphology changes to flake morphology. As the Henrian oxygen activity approaches $10^{-4}$, the equilibrium oxygen level attributable to the presence of 3.5% carbon in the melt at a carbon monoxide partial pressure of one atmosphere at 1500° C., as represented by the horizontal line in FIG. 3, flake graphite morphology is obtained, irrespective of the control of sulfur to rather low levels. These observations have led to the discovery that compacted graphite morphology in thinner sections of the castings is critically dependent upon the dissolved oxygen concentration in the melt.

The Henrian activity, $h_i$ f any component i in solution in iron is the effective concentration of that component in the iron melt and is given by $$h_i = f_i \times [w\ \%\ i]$$

where [w % i] is the weight percent of component i and $f_i$ is the Henrian activity coefficient of component i. The activity coefficient $f_i$ can be calculated from the relationship $$\log f_i = \sum_{j=2}^{n} e_i^j [w\% j] + \sum_{j=2}^{n} r_i^j [w\% j]^2$$

where $e_i^j$ and $r_i^j$ are the first order and second order interaction parameters which are determined for the system of interest by conventional thermodynamic techniques, such as those set forth in Thermodynamics of Alloys, Carl Wagner, Addison-Wesley Publishing Company, Reading, Massachusetts (1952).

The processes of the present invention are based on the discovery that graphite morphology in the melt is determined by impurity dependent crystal growth mechanisms, oxygen being identified as a key impurity that influences growth morphology of graphite. The processes of the present invention are further based on the discovery that the control of the dissolved oxygen impurity concentration in the cast iron melt, corresponding to a Henrian oxygen activity of about $10^{-6}$ is essential for the consistent production of compacted graphite in thin walled shaped castings. According to the instant invention, the mere removal of sulfur is an inadequate condition for compacted morphology control. In the absence of sulfur, oxygen as an impurity, because of its strong bond energy with carbon can promote flake growth even at low concentrations. In this regard, it should be noted that in cast iron, which is carbon saturated, soluble oxygen concentration is extremely low, typically on the order of 5 parts per million by weight. Because of this low level of oxygen, the critical role of oxygen impurity in influencing graphite growth morphology, especially in the context of graphite morphology control, heretofore has not been recognized. Rather, the emphasis has been placed on other impurities, in particular sulfur. Although the removal of sulfur is an essential condition for graphite morphology control, it is not a sufficient condition. Thus, according to the present invention, compacted graphite morphology can be established in a melt with a Henrian sulfur activity of $10^{-3}$, only if the Henrian oxygen activity is preferably maintained at about $10^{-6}$, but within the range from $10^{-5.5}$ to $10^{-6.5}$. Thus the present invention is based on the discovery that compacted graphite morphology in a thin walled shaped casting can be quantitatively related to soluble oxygen concentration in the melt, corresponding to a Henrian oxygen activity level of about $10^{-6}$, the window of the compacted graphite morphology being rather narrow in terms of Henrian oxygen activity but extends to the ultra sulfur range, as shown by the cross-hatched area in FIG. 3.

Rare earths offer distinct advantage over magnesium to reduce and maintain the Henrian oxygen activity in the range required to obtain compacted graphite morphology, because rare earths have rather low vapor pressure at the treatment temperatures involved compared with magnesium. Further, rare earths have extended solubility in iron compared with calcium.

The amount of rare earth alloys added depends upon the rare earth concentration in the alloy, the melt chemistry, the amount of tramp elements carried by the melt, the percentage recovery, and the extent of reoxidation. The rare earth addition is based on reducing the Henrian oxygen activity in the melt to within the range of about $10^{-7}$ to $10^{-5}$, more preferably to within the ranges of about $10^{-6.5}$ to $10^{-5.5}$ and most preferably to about $10^{-6}$. The rare earths for use in the present invention are the elements of the lanthanide series of the Periodic Table Of the Elements, plus yttrium. Thus, rare earths such as cerium, praseodymium, neodymium, promethium, samarium, europium, gadolinium, terbium, dysprosium, holmium, erbium, thulium, lutetium and mixtures thereof can be suitably employed. Similarly, ores, compounds or metals containing a mixture of rare earths such as rare earth fluorides, rare earth fluoro carbonates, misch metals, rare earth silicides, rare earth aluminum silicide alloys, nickel-cerium alloys and the like, can be suitably employed. Cerium rich rare earth contained in ferro-silicon is found to give consistent results. The amount of rare earth added is based on the reaction products produced, which include, rare earth oxysulfide ($Re_2O_2S$) and rare earth sulfides of the type $Re_2S_4$ and ReS. Depending upon the sulfur level and the recovery rate, suitable addition rates for rare earths in accordance with the present invention have been found to range from about 0.05 wt. % to 0.15 wt % of the melt weight.

Other surface active elements such as selenium and tellurium and tramp elements such as tin, lead, bismuth, and antimony, if present, can also be rendered innocuous by the addition of suitable quantities of rare earths. The addition rates for tramp elements are usually small, as compared with amounts needed to produce compacted graphite and are as practiced in current nodular iron technology.

In order to maintain the melt at the reduced Henrian oxygen activity level of about $10^{-6}$, it is essential to add a calculated excess of rare earths to buffer the melt against reoxidation, appropriate to the plant practice. In an automated high productivity system, the excess rare earth required to counteract reoxidation can be readily established.

It is an essential aspect of the processes of the present invention to prevent carbide (cementite) formation. Once the cementite phase is allowed to nucleate, the competitive growth of cementite dominates over that of graphite. In order to overcome the competitive growth of cementite over graphite, ternary addition of graphite stabilizing agents such as silicon to the melt is made, such that the driving force for graphite growth is selectively increased, and yet the driving force for the nucleation and growth of cementite is suppressed. Ternary silicon addition raises the graphite eutectic temperature and depresses the temperature of carbide eutectic in an iron-carbon-silicon ternary equilibrium diagram, thus providing the driving force for graphite growth selectively. It is essential to control the concentration of carbide stabilizing elements in the base iron. For example, in the case of Cr or Mn addition, the silicon concentration should be adjusted to suppress the carbide formation. A typical chemistry of the base metal consists of carbon in the range of 3.5 to 4.0% by weight, Mn up to 1.2%, Si in the range of 1.0 to 2.5% and sulfur around 0.01%. If desired, additional alloying elements such as nickel, molybdenum, copper and chromium can be used for special purposes. Conventional desulfurization procedures should precede the use of the base metal in the processes of the present invention to ensure consistently low sulfur levels in the melt.

The analysis of the nodularity problem in thinner sections is one of kinetics of crystal growth. Impurity dependent crystal growth mechanisms operate at smaller kinetic undercooling and promote prism flake growth. In the absence of impurities, prism flake growth is suppressed and basal spiral growth operates at large kinetic undercooling (large driving force) resulting in spherulitic morphology. Compacted graphite morphology involves growth of the prism and basal faces of graphite, and therefore impurity control in the melt is a critical step. However, at large kinetic undercooling characteristic of thin sections, impurity dependent crystal growth mechanisms are dominated by spiral growth, leading to increased nodularity. In order to reduce the nodularity problem in thinner sections, it is essential to reduce the degree of growth undercooling. An essential aspect of this invention is the discovery that the growth undercooling of graphite can be reduced by increasing the degree of nucleation, but that there exists an optimum degree of nucleation to promote the required degree of interconnected growth of compacted graphite under a reduced degree of growth undercooling. Thus, the processes of the instant invention emphasize not only exerting control over the impurity concentration in the melt, notably oxygen, but also controlling the degree of nucleation of graphite in the melt entering the mold. An essential aspect of this invention is the optimization of the number of nuclei in the melt, such that the required degree of interconnected vermicular graphite growth is promoted. Far too many nuclei tend to promote nodularity and suppress the interconnected vermicular graphite growth. On the other hand, far too few nuclei can promote carbide formation. Thus, according to the instant invention, there exists an optimum number of graphite nuclei to promote the required degree of coupled or interconnected growth of graphite.

The processes of the present invention are based on the discovery that optimum nucleation is a crucial step for obtaining compacted graphite morphology in thin walled shaped castings, and therefore, this process step is recited as an integral part of the processes of the present invention. Even though it is not possible to control the number and periodicity of dispersion of graphite nuclei per se, the processes of the present invention are based on exerting control over the nucleation step by carrying out inoculation for each individual mold, just as the melt enters the mold cavity. This process step eliminates the holding and handling of the melt after inoculation and, therefore, eliminates the variables associated with the coalescence and flotation of nucleants and any possible impairment of nucleating substrates on account of reoxidation. Since the deoxidation and desulfurization reaction products are potential sites for the heterogeneous nucleation of graphite, the processes of the present invention stress the importance of the control of base metal sulfur to consistently low levels for better reproducibility of results. It should be pointed out that the processes of the instant invention lay emphasis on the principle of optimum degree of nucleation of graphite in order to achieve the required degree of interconnected growth of graphite, irrespective of the type of inoculant chosen or the technique of inoculation adopted. For instance, according to the processes of the present invention, finely graded 75% Si foundry grade inoculant added to the melt in one of the following ways have been found to give carbide free compacted graphite structure:

(i) inoculation into the pouring ladle just before pouring
(ii) stream inoculation as the melt is discharged into the pouring basin
(iii) inoculation into the pouring basin
(iv) inoculation in the path of the molten metal flow inside the mold, in particular in the reaction chamber designed for nodularizing treatment inside the mold.

Each of these techniques is compatible with a high productivity automated casting line. It has been found that graded ferrosilicon (75% Si) gives adequate nucleation of graphite to eliminate the carbides in thin sections, but the quantity of treatment required optimization to promote the required degree of interconnected vermicular graphite growth. Other commercial grade inoculants, such as compacts or inserts made out of inoculants are compatible with the processes of the instant invention. It is essential to design the treatment such that the graphite nuclei are uniformly dispersed in the melt. Thus, for example, a controlled dissolution of the insert in the path of the molten metal can be ensured throughout the entire flow of molten metal, thereby promoting a uniform distribution of the inoculant, as described in U.S. Patent No. 3,658,115.

In another variation of the processes of the present invention, the rare earth-containing additive and the inoculant can be added to the cast iron melt in the ladle by injection metallurgy techniques or wire feeding techniques, just prior to pouring the molten metal into the pouring basin.

In accordance with the foregoing, it has been found that the melt containing adequate silicon and low sulfur, on rare earth treatment to lower and maintain the Henrian oxygen activity at about $10^{-6}$ and optimum nucleation by inoculation, upon pouring into a sand mold solidifies to give a uniformly distributed compacted graphite morphology over a wide ranges of section sizes.

The following examples further illustrate the present invention. The examples are included solely for purposes of illustration and are not to be construed in limitation of the present invention. Unless otherwise specified, all percentages and parts are by weight.

EXAMPLE 1

Compacted graphite castings were produced by the high productivity, automated process of the present invention using the following process steps:

(i) Rare earth carried in a ferro-silicon alloy was dispensed into returning empty ladles at an alloy dispensing station.

(ii) Liquid metal was tapped onto the alloy in the ladle.

(iii) Optimum amount of inoculant was placed into an in-mold reaction chamber before closing mold.

(iv) The rare earth treated liquid melt from the pouring ladle was poured into the mold carrying the inoculant in the in-mold reaction chamber.

The quantity of the liquid metal dispensed by each ladle was 230 lbs. The chemistry of the desulfurized hot metal was as follows:

| | |
|---|---|
| Carbon | 3.6–3.7 wt % |
| Sulfur | 0.008 wt % |
| Mn | 0.53 wt % |
| Si | 1.6–1.8 Wt % |

Rare earth was added in the form of a rare earth containing ferro-silicon alloy containing 11% rare earths. The alloy had a size grading between −4 mesh and +8 mesh. The amount of alloy added corresponded to a rare earth addition of 0.05 wt % of the melt weight. The melt was poured at 2570° F.

The inoculant used was 75% Si-containing ferrosilicon. The grading of the inoculant used ranged in size between −20 mesh and +100 mesh. The quantity of the inoculant used was 0.4% of the melt weight.

The variations in section thickness of each casting ranged from 22 mm. for the thickest section to 4 mm. for the thinnest section. FIG. 8 shows photographs of the thick and thin casting sections which are used for metallographic investigation.

FIG. 9 illustrates the typical microstructure of compacted graphite obtained in a ferrite-pearlite matrix, essentially free of eutectic carbides, which was obtained in the thinnest section (4 mm. thick). The pearlite content ranged from 25–35%.

FIG. 10 illustrates the typical microstructure of compacted graphite in a ferrite-pearlitic matrix, essentially free of eutectic carbides which was obtained in the thickest section (22 mm. thick). The amount of pearlitic content ranged from 20–30%.

Six sections were taken from each automotive casting to confirm the uniformity of structure. In general, the process ensures total absence of eutectic carbides even in sections as thin as 4 mm. The nodularity in the thinnest section, though present, was significantly reduced, which can be clearly seen by comparison with FIG. 2.

EXAMPLE 2

The section sizes of the casting ranged from ¾" to ¼". A commerical grade rare earth silicide was used in this Example, with the following analysis: 31.2% rare earths, 35% Si, 0.16% C and 33.5% Fe. The treatment procedure was identical to that used in Example I. The microstructural results are shown in FIG. 11, which clearly show that the section sensitivity can be minimized by programmed rare earth treatment and optimum nucleation.

The melt was held in the pouring ladle for 20 minutes after rare earth treatment, but before pouring into the mold. This would simulate an extreme condition of line break-down, in a continous flow operation. The microstructual results pertaining to thin and thick sections of a typical casting are shown in FIG. 12. The remarkable persistence of compacted graphite morphology in thin and thick sections of the casting can be clearly seen.

What is claimed is:

1. Method for producing compacted graphite cast iron exhibiting a uniform distribution of compacted graphite in shaped castings of varying cross sectional dimensions within the range of ⅛ inch to ¾ inch comprising:

(i) forming a near eutectic melt of cast iron having the chemistry of a ductile base metal and low sulfur content;

(ii) admixing sufficient graphite stabilizing agent with said melt to suppress carbide eutectic formation;

(iii) admixing at least one rare earth-containing reduce and maintain the Henrian activity of residual oxygen in the melt within the range of from about $10^{-5}$ to $10^{-7}$;

(iv) innoculating the melt immediately prior to casting with a graded innoculant in an amount sufficient to permit interconnected compacted graphite growth; and (v) casting the resulting melt.

2. Method for producing compacted graphite cast iron as defined in claim 1 wherein the sulfur content of the near eutectic melt is about 0.01% by weight.

3. Method for producing compacted graphite cast iron as defined in claim 1 wherein the graphite stabilizing agent is silicon.

4. Method for producing compacted graphite cast iron as defined in claim 1 wherein sufficient rare-earth containing additive is admixed with the melt to reduce and maintain the Henrian activity of residual oxygen in the melt within the range of about $10^{-5.5}$ and $10^{-6.5}$.

5. Method for producing compacted graphite cast iron as defined in claim 1 wherein sufficient rare-earth containing additive is admixed with the melt to reduce and maintain the Henrian activity of residual oxygen in the melt at about $10^{-6}$.

6. Method for producing compacted graphite cast iron as defined in claim 1 wherein sufficient graphite stabilizing agent to suppress carbide eutectic formation is present in the melt from silicon additions in the near eutectic melt and/or the rare earth-containing additive.

7. Method for producing compacted graphite cast iron as defined in claim 1 wherein the rare earth-containing additive is charged to the pouring ladle prior to tapping the melt into the pouring ladle.

8. Method for producing compacted graphite cast iron as defined in claim 1 wherein the melt is inoculated as the melt enters the casting mold.

9. Method for producing compacted graphite cast iron as defined in claim 1 wherein the melt is inoculated inside the casting mold.

10. Method for producing compacted graphite cast iron as defined in claim 1 wherein the inoculant is ferrosilicon.

11. Method for producing compacted graphite cast iron as defined in claim 1 wherein the inoculant is finely graded ferrosilicon (75% silicon) foundry grade inoculant.

12. Method for producing compacted graphite cast iron as defined in claim 1 wherein the rare earth-containing additive is admixed with said melt in amounts ranging from about 0.05 wt. % to 0.15 wt. % based on the weight of the melt.

13. Method for producing compacted graphite cast iron as defined in claim 1 wherein an excess of rare earth containing additive over that amount required to reduce and maintain the Henrian activity of residual oxygen in the melt within the range of from about $10^{-5}$ to $10^{-7}$ is admixed with the melt to buffer the melt against reoxidation.

14. Method for producing compacted graphite cast iron as defined in claim 1 wherein the rare earth-containing additive and inoculant are injected into the melt.

* * * * *

UNITED STATES PATENT AND TRADEMARK OFFICE

CERTIFICATE OF CORRECTION

PATENT NO. : 4,806,157

DATED : February 21, 1989

INVENTOR(S) : Sundaresa V. Subramanian

It is certified that error appears in the above-identified patent and that said Letters Patent is hereby corrected as shown below:

In Claim 1, column 12, line 8 of the patent, insert -- additive with said melt in an amount sufficient to -- after the phrase "earth-containing".

In Claim 1, column 12, line 12 of the patent, change "innoculating" to -- inoculating --.

In Claim 1, column 12, line 13 of the patent, change "innoculant" to -- inoculant --.

In the specification, at column 4, line 49 of the patent, change "intermiteently" to -- intermittently --.

In the specification, column 7, line 13 of the patent, change "$h_j f$" to -- $h_j$ of --.

Signed and Sealed this

First Day of August, 1989

*Attest:*

*Attesting Officer*

DONALD J. QUIGG

*Commissioner of Patents and Trademarks*